US005441582A

United States Patent [19]

Fujita et al.

[11] Patent Number: 5,441,582

[45] Date of Patent: Aug. 15, 1995

[54] METHOD OF MANUFACTURING NATURAL AGING-RETARDATED ALUMINUM ALLOY SHEET EXHIBITING EXCELLENT FORMABILITY AND EXCELLENT BAKE HARDENABILITY

[75] Inventors: Takeshi Fujita; Shinji Mitao; Kohei Hasegawa; Masataka Suga, all of Tokyo, Japan

[73] Assignee: NKK Corporation, Tokyo, Japan

[21] Appl. No.: 188,155

[22] Filed: Jan. 27, 1994

[30] Foreign Application Priority Data

Sep. 30, 1993 [JP] Japan ..... 5-245195

[51] Int. Cl.[6] ..... C22C 21/08

[52] U.S. Cl. ..... 148/693; 148/418; 148/439; 148/690; 420/535; 420/532

[58] Field of Search ..... 148/693, 439, 418, 690; 420/530, 532, 535

[56] References Cited

U.S. PATENT DOCUMENTS

| | | | |
|---|---|---|---|
| 4,645,543 | 2/1987 | Watanabe et al. | 148/2 |
| 4,909,861 | 3/1990 | Muraoka et al. | 148/12.7 A |
| 5,240,522 | 8/1993 | Tanaka et al. | 148/693 |

FOREIGN PATENT DOCUMENTS

| | | |
|---|---|---|
| 53-103914 | 9/1978 | Japan . |
| 57-120648 | 7/1982 | Japan . |
| 1-225738 | 9/1989 | Japan . |
| 2-47234 | 2/1990 | Japan . |
| 4-131348 | 5/1992 | Japan . |
| 4-263034 | 9/1992 | Japan . |
| 4-304339 | 10/1992 | Japan . |
| 4-365834 | 12/1992 | Japan . |
| 5-70907 | 3/1993 | Japan . |
| 5-125505 | 5/1993 | Japan . |

OTHER PUBLICATIONS

Patent Abstracts of Japan, vol. 17, No. 124 (C-1035), Mar. 16, 1993 of JP 4 304 339.

Patent Abstracts of Japan, vol. 17, No. 492 (C-1107), Sep. 7, 1993 of JP 5 125 505.

Patent Abstracts of Japan, vol. 17, No. 236 (C-1057), May 13, 1993 of JP 4 365 834.

Patent Abstracts of Japan, vol. 17, No. 52 (C-1022), Feb. 2, 1993 of JP 4 263 034.

Patent Abstracts of Japan, vol. 16, No. 400 (C-0977), Aug. 25, 1992 of JP 4 131 348.

Yasunori Kombatsu et al, Development of Aluminum body for Automotive, Jifosha Gijyutu (Automobile Technology), vol. 45, No. 6 (1991), 45, pp. 42–48.

Hideo Yoshida et al, Properties of Aluminium Alloy Sheets for Auto Bodies, Sumi-kei Giho (Sumitomo Light metal technology report), vol. 32, No. 1 (1991), 20, pp. 20–31.

*Primary Examiner*—Scott Kastler
*Assistant Examiner*—Sean Vincent
*Attorney, Agent, or Firm*—Frishauf, Holtz, Goodman & Woodward

[57] ABSTRACT

Disclosed is a method manufacturing an aluminum alloy sheet comprising preparing an aluminum alloy ingot essentially consisting of 1.5 to 3.5% by weight of Mg, 0.3% to 1.0% by weight of Cu, 0.05 to 0.35% by weight of Si, 0.03 to 0.5% by weight of Fe, 0.005 to 0.15% by weight of Ti, 0.0002 to 0.05% by weight of B and a balance of Al, in which the ratio of Mg/Cu is in the range of 2 to 7, homogenizing the ingot in one step or in multiple steps, performed at a temperature within the range of 400° to 580° C., preparing an alloy sheet having a desired sheet thickness by subjecting the ingot to a hot rolling and a cold rolling, subjecting the alloy sheet to a heat treatment including heating the sheet up to a range of 500° to 580° C. at a heating rate of 3° C./second or more, keeping it at the temperature reached for 0 to 60 seconds, and cooling at a cooling rate of 2° C./second or more, subjecting the alloy sheet to a preliminary aging treatment performed at a temperature within the range of 45° to 100° C. for 2 to 48 hours after keeping at room temperature or immediately after the heat treatment, and subjecting the alloy sheet to a restoring treatment performed at a temperature within the range of 180° to 300° C. for 3 to 60 seconds. Thus, a natural aging-retardated aluminum alloy sheet exhibiting excellent formability and excellent bake hardenability is obtained.

12 Claims, No Drawings

METHOD OF MANUFACTURING NATURAL AGING-RETARDATED ALUMINUM ALLOY SHEET EXHIBITING EXCELLENT FORMABILITY AND EXCELLENT BAKE HARDENABILITY

BACKGROUND OF THE INVENTION

1. Field of the Invention

The present invention relates to a method of manufacturing an aluminum alloy sheet, more particularly, to a method of manufacturing an aluminum alloy sheet having excellent formability and excellent bake hardenability, having natural aging retardation property exhibiting no change in strength with time prior to being subjected to press forming, and suitable for use in an automobile body sheet.

2. Description of the Related Art

A conventional surface-treated cold-rolled steel sheet has frequently been used as a sheet material for an automobile body panel. In recent years, however, for the purpose of reducing fuel consumption, a light-weight automobile body panel material has been demanded. To satisfy the demand, an aluminum alloy sheet has begun being used for the automobile body panel.

Nowadays, manufacturers in-press forming of panel sheets are requesting that the material not only have low yield strength until being subjected to press forming so as to provide a satisfactory shape-retaining property [Jidosha Gijyutu (Automobile Technology), Vol. 45, No. 6 (1991), 45)], but also have a property such that strength thereof can improved during paint baking to provide satisfactory formability of deep drawing and overhang, and dent resistance.

Under these circumstances, an attempt has been made in which the strength of the material was improved by adding Cu and Zn to a non-heat treated type, Al—Mg based alloy which has superior formability to other aluminum alloys. As a result, an Al—Mg—Cu system alloy (Jpn. Pat. Appln. KOKAI Publication Nos. 57-120648, 1-225738), an Al—Mg—Cu—Zn system alloy (Jpn. Pat. Appln. KOKAI Publication No. 53-103914), and the like have been developed. These alloy sheets are superior to an Al—Mg—Si system alloy sheet but inferior to a conventional surface-treated cold-rolled steel sheet in formability, and exhibit a poor shape-retaining property since the alloy sheets have high strength prior to being press formed. In addition, the degree of hardening obtained by paint baking is not sufficient, and the degree of hardening is low only to prevent a work hardening value obtained by press-forming from lowering. In Jpn. Pat. Appln. KOKAI Publication No. 57-120648, an attempt has been made to improve the strength at the time of the paint baking by precipitating an Al—Cu—Mg system compound; however, the results have not been satisfactory. Since the effect of Si in improving baking hardness was not yet discovered at the time the aforementioned application was made, Si was limited to a low level.

A conventional 5052 material is used in the automobile body panel. Although it exhibits a superior shape-retaining property owning to low yield strength prior to being subjected to press forming, 5052-0 is inferior in dent resistance since satisfactory hardness cannot be provided by paint baking.

The above mentioned Al—Mg—Cu or Al—Mg—Cu—Zn system alloys have a common disadvantage in that the alloys exhibit a secular change in the strength prior to being subjected to press forming since natural aging starts right after the final heat treatment ["Report of 31th light metal annual symposium", Sumi-kei Giho (Sumitomo Light metal technology report), vol. 32, No. 1 (1991), 20, page 31)]. Therefore, it is necessary to control timing of the manufacturing raw material and heat treatment, and a period of time from the heat treatment to press forming.

One technique of suppressing the change in the strength with time by natural aging is provided by Jpn. Pat. Appln. KOKAI Publication No. 2-47234, which discloses that natural aging of the Al—Mg—Cu—Zn system alloy is suppressed by reducing a content of Zn, which has a significant effect on natural aging.

Nevertheless, heretofore, the Al—Mg—Cu alloy and Al—Mg—Cu—Zn alloy do not satisfy at least one of bake hardenability shape-retaining property, and natural aging retardation property, even though they may have excellent formability relatively close to that of steel.

On the other hand, another technique of improving the natural aging property as well the as bake hardenability by performing a heat treatment of two steps to an Al—Mg—Si alloy in which bake hardenability is increased by forming a GP zone of Mg2Si is disclosed in Jpn. Pat. Appln. KOKAI Publication No. 5-70907.

Although the Al—Mg—Si alloy has excellent bake hardenability, the Al—Mg—Si alloy has poor formability, it is necessary to improve the formability in the alloy of the publication.

SUMMARY OF THE INVENTION

The present invention has been made in view of the above circumstances. An object of the present invention is to provide a manufacturing an aluminum alloy sheet exhibiting excellent formability and an excellent natural aging retardation property, accordingly exhibiting no change in strength with time prior to being subjected to press forming and having excellent bake hardenability even if baking is performed at a low temperature for a short period of time.

According to the present invention, there is provided a method of manufacturing a natural aging-retardated aluminum alloy sheet exhibiting excellent formability and excellent bake hardenability, said method comprising the steps of:

preparing an aluminum alloy ingot essentially consisting of 1.5 to 3.5% by weight of Mg, 0.3 to 1.0% by weight of Cu, 0.05 to 0.35% by weight of Si, 0.03 to 0.5% by weight of Fe, 0.005 to 0.15% by weight of Ti, 0.0002 to 0.05% by weight of B and a balance of Al, in which the ratio of Mg/Cu is in the range of 2 to 7;

homogenizing the ingot in one step or in multiple steps, performed at a temperature within the range of 400° to 580° C.;

preparing an alloy sheet having a desired sheet thickness by subjecting the ingot to a hot rolling and a cold rolling;

subjecting the alloy sheet to a heat treatment including heating the sheet up to a range of 500° to 580° C. at a heating rate of 3° C./second or more, keeping it at the temperature reached for 0 to 60 seconds, and cooling at a cooling rate of 2° C./second or more;

subjecting the alloy sheet to a preliminary aging treatment performed at a temperature within the range of 45° to 100° C. for 2 to 48 hours after keeping at room temperature or immediately after said heat treatment; and subjecting the alloy sheet to a restoring treatment performed at a temperature within the range of 180° to 300° C. for 3 to 60 seconds.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The present inventors have made intensive and extensive studies with a view toward attaining the above mentioned objects. As a result, they found that a natural aging retardation property can be imparted to an aluminum alloy sheet, while desirably maintaining formability and bake hardenability by suitably defining the alloy composition on the basis of Al—Mg—Cu alloy and by controlling manufacturing conditions. The present invention was made based on the finding of the present inventors and as a result of expensive studies of alloy components and manufacturing conditions.

The present invention thus provides a method of manufacturing an aluminum alloy sheet comprising:

preparing an aluminum alloy ingot essentially consisting of 1.5 to 3.5% by weight of Mg, 0.3 to 1.0% by weight of Cu, 0.05 to 0.35% by weight of Si, 0.03 to 0.5% by weight of Fe, 0.005 to 0.15% by weight of Ti, 0.0002 to 0.05% by weight of B and a balance of Al, in which the ratio of Mg/Cu is in the range of 2 to 7;

homogenizing the ingot in one step or in multiple steps, performed at a temperature within the range of 400° to 580° C.;

preparing an alloy sheet having a desired sheet thickness by subjecting the ingot to a hot rolling and a cold rolling;

subjecting the alloy sheet to a heat treatment including heating the sheet up to a range of 500° to 580° C. at a heating rate of 3° C./second or more, keeping it at the temperature reached for 0 to 60 seconds, and cooling at a cooling rate of 2° C./second or more;

subjecting the alloy sheet to a preliminary aging treatment with the range of 45° to 100° C. for 2 to 48 hours after keeping at room temperature or immediately after said heat treatment; and subjecting the alloy sheet to a restoring treatment within the range of 180° to 300° C. for 3 to 60 seconds.

According to the method, a natural aging retardated aluminum alloy sheet exhibiting excellent formability and excellent bake hardenability is obtained.

If at least one additional element selected from the group consisting, 0.01 to 0.50% by weight of Mn, 0.01 to 0.15% by weight of Cr, 0.01 to 0.12% by weight of Zr, 0.01 to 0.18% by weight of V, and 0.5% or less by weight of Zn, is further contained in the alloy, an aluminum alloy sheet having more excellent properties can be obtained without lowering the advantages of the present invention.

The present invention will now be explained in detail.

The alloy composition of the present invention is based on an Al—Mg—Cu alloy, and excellent bake hardenability is given to the alloy by forming a modulated structure (GPB zone) appearing prior to precipitating a precipitation phase of Al—Cu—Mg compound in the alloy, thereby exhibiting excellent formability and excellent bake hardenability.

Hereinbelow, the reason why individual components are defined as described above will be explained. Each content is shown in the terms of weight percentages.

Mg: Mg is a constitutional element of the Al—Cu—Mg modulated structure of the present invention which contributes to bake hardenability. At the Mg content of less than 1.5%, the generation of the modulated structure is retarded, and ductility is lowered. On the other hand, when the content exceeds 3.5%, the generation of the modulated structure is also retarded, and no modulated structure is generated, when the alloy sheet is subjected to baking at a low temperature for a short period of time. Therefore, the Mg content is defined within a range of 1.5 to 3.5%.

Cu: Cu is a constitutional element of the Al—Cu—Mg system modulated structure of the present invention. At the Cu content of less than 0.3%, the modulated structure cannot be generated. When the content exceeds 1.0%, hot workability and formability are lowered and corrosion resistance deteriorates. Therefore, the content of Cu is defined within a range of 0.3 to 1.0%.

The ratio of Mg to Cu (Mg/Cu) is defined within the range of 2 to 7. Within the range, the Al—Cu—Mg modulated structure can be effectively generated.

Si: Si is an element which improves a hardenability by facilitating generation of the Al—Cu—Mg modulated structure. To perform the function efficiently, it is desirable that the Si content is 0.05% or more. When the Si content exceeds 0.35%, the above mentioned modulated structure is generated, however, at the same time, coarse $Mg_2Si$ is also generated, thereby lowering formability. Therefore, the Si content is defined within the range of 0.05% to 0.35%.

Fe: When Fe is present in a content of 0.50% or more, a coarse crystal is readily formed with presence of Al, and also reduces the content of Si which is effective to form the modulated structure by binding to Si. However, since a small amount of Fe contributes to formability and the effect can be obtained when the amount is 0.03% or more. Therefore, the Fe content is defined within the range of 0.03% to 0.50%.

Ti, B: Ti and B are present in the form of $TiB_2$, which improves the workability during hot working by making crystal grains of the ingot fine. Therefore, it is important to add Ti together with B. However, an excess content of Ti and B facilitates generation of a coarse crystal thereby causing deterioration of the formability. Therefore, the contents of Ti and B are in the range such that the effect can be obtained efficiently, that is, the range of 0.005 to 0.15, and 0.0002 to 0.05%, respectively.

The reason why the content of each of the optional components is defined described above is as follows:

Mn, Cr, Zr, V: These elements are recrystallization suppressing elements. In order to suppress abnormal grain growth, these elements may be added in an appropriate amount. However, these elements have a negative effect on equiaxed formation of the recrystallized particle, causing deterioration of the formability. When these elements are employed in excessive amounts the crystal grains are too fine, thereby causing a lowering of elongation and generation of stretcher strain (SS) marks. Therefore, the content of these elements should be limited to less than that contained in a conventional aluminum alloy. Hence, if added, the contents of Mn, Cr, Zr, and v are defined to 0.01 to 0.50%, 0.01 to 0.15%, 0.01 to 0.12%, and 0.01 to 0.18%, respectively.

Zn: Zn is an element which contributes to improving strength. However, the content in excess of 0.5% reduces the degree of baking hardening. To be more specific, in the Zn content exceeding 0.5%, a modulated structure, which is the stage prior to the precipitation of the Al—Zn compound, may be generated. The modulated structure, however, can be also generated at ordinary temperature and the strength of the alloy sheet prior to be subjected to baking, remarkably increases with time, thereby decreasing the degree of baking hardening. Therefore, it is necessary that the content of Zn should not be exceed 0.5%.

As the other element, Be may be added up to 0.01%. Be prevents oxidation at the time of casting, thereby improving castability, hot workability, and formability of an alloy sheet. However, a Be content in excess of 0.01% is not preferable because not only the effect is saturated but also Be turns into a strong poison to damage the working circumstances at the time of casting. Therefore the upper limit of the Be content should be 0.01%.

Besides the above mentioned elements, inevitable impurities are also contained in the aluminum alloy sheet as observed in a conventional alloy. The amount of the inevitable impurities is not limited as long as it does not ruin the effect of the present invention.

An aluminum alloy ingot whose components and compositions are defined above is then subjected to a heating treatment for homogenization at a temperature in the range of 400° to 580° C. in one step or in multiple steps, thereby facilitating a diffusion dissoluting of an eutectic compound crystallized at a casting process, and reducing local microsegregation. Further, the homogenizing treatment suppresses abnormal growth of crystal grains. As a result, fine grains of compounds of Mn, Cr, Zr, and V, which perform an important function in homogenizing the alloy, can be finely precipitated. However, when the homogenizing treatment is performed at a temperature less than 400° C., the above mentioned effect could not be sufficiently obtained. When the treatment is performed at a temperature in excess of 580° C., a eutectic melting would occur. Therefore, the temperature of the homogenizing treatment is defined in the range of 400° to 580° C. When the treatment is performed for the period of time less than one hour at a temperature in the range mentioned above, the effect could not be sufficiently obtained. On the other hand, when this treatment is performed over 72 hours, the effect is saturated. Hence, it is desirable that the reaction time is 1 to 72 hours.

An ingot completed with the homogenizing treatment is then subjected to a hot rolling and a cold rolling to obtain a sheet having a predetermined thickness by conventional procedure. In order to straighten or to adjust surface roughness, 5% or less of leveling, stretching or skin pass rolling may be performed before or after, or before and after the following heat treatment.

After the rolling step, the rolled sheet is subjected to a heat treatment including heating the sheet up to a temperature within the range of 500° to 580° C. at a heating rate of 3° C./second or more; then keeping the sheet for at most 60 seconds at the temperature reached or not keeping; and cooling the sheet rapidly at a cooling rate of 2° C./second or more.

The heat treatment is performed in order to intend to dissolve Cu and Mg which are the constituents of the modulated structure mode of the Al—Cu—Mg compound to the alloy and to obtain the sufficient degree of bake hardening. In this case, when the heating treatment is performed less than 500° C., the above mentioned effect could not be sufficiently obtained. On the other hand, when the temperature exceeds 580° C.; when the heating rate is less than 3° C./second; or when the keeping time exceeds 60 seconds, abnormal grain growth would be readily occurred in certain grains, thereby lowering formability. Further, it is not preferable that the cooling rate is less than 2° C./second in view of increasing bake hardening, since the Al—Cu—Mg compound is precipitated during the cooling step.

After the solution treatment, the alloy sheet is subjected to a preliminary aging treatment performed at a temperature within the range of 45° to 110° C. for 2 to 48 hours after keeping at room temperature or immediately after the solution heat treatment. According to the preliminary aging treatment, frozen vacancies formed by the quenching of the solution treatment which promote formation of the modulated structure are decreased, and a natural aging is suppressed without lowering bake hardenability. When the preliminary aging treatment is performed at a temperature less than 45° C., the effect of decreasing the vacancies is small and the treating time become long. On the other hand, when the treatment is performed at a temperature more than 110° C., although the frozen vacancies are decreased, a modulated structure which is stable even in a restoring treatment performed thereafter is formed. Therefore, the yield strength of the alloy sheet is not lowered, and the shape-retaining property, formability and bake hardenability are low. When the treatment is performed for the period of time less than 2 hours, the effect of decreasing the vacancies is small. When the treatment is performed over 72 hours, a modulated structure which is stable even in a restoring treatment performed thereafter is formed. Therefore, the yield strength of the alloy sheet is not lowered, and the shape-retaining property, formability and bake hardenability are low.

The alloy sheet is subjected to a restoring treatment as a final heat treatment performed at a temperature within the range of 180° to 300° C. for 3 to 60 seconds. This low temperature heat treatment is performed to stabilize GPB zone of Al—Cu—Mg compound modulated structure which is formed in the preliminary aging treatment for decreasing the frozen vacancies in the room temperature. When the temperature of the treatment is less than 180° C. or the keeping time of the treatment is less than 30 seconds, the above mentioned effect could not be sufficiently obtained. On the other hand, when the temperature of the treatment is more than 300° C. or the keeping time of the treatment is more than 60 seconds, a coarse Al—Cu—Mg compound is precipitated, thereby reducing bake hardenability and increasing concentration of vacancies.

Since the aluminum alloy sheet thus obtained exhibits excellent press formability and excellent paint bake hardenability and has natural aging retardation property, the aluminum alloy sheet is suitable for use in an automobile body sheet.

EXAMPLES

Hereinafter the Examples of the present invention will be described.

Example 1

An alloy comprising the components in the contents shown in Tables 1 and 2, was melted, continuously casted to form ingots. The obtained ingots were subjected to facing. The ingots were subjected to a 2-step homogenization treatment, first for 4 hours at 440° C., and second, for 10 hours at 510° C. Then, the ingots were heated to 460° C. and subjected to a hot-rolling to form sheets having thickness of 4 mm. After cooled at room temperature, the above obtained sheets were subjected to a cold-rolling to obtain a sheets having thickness of 1 mm. Note that, the finish temperature of the hot rolling treatment was 280° C.

cup value (CCV) denotes the complex formability of overhang and deep drawing. The smaller the CCV is, the better the formability obtained.

In order to simulate paint baking following press forming, a heat treatment was carried out at 170° C. for 20 minutes. This treatment corresponds to an actual baking step. Again, the-tensile test was performed in substantially the same condition as in the above.

These test results are shown in Tables 3 and 4. The value of the column "bake hardening" is obtained by subtracting yield strength after the final heat treatment from that after the heat treatment simulating the actual baking step.

Alloys Nos. 1 to 13 of Table 1 are examples the compositions of which are within the range of the present invention. On the contrary, the alloys Nos. 14 to 26 of Table 2 are comparative examples the compositions of which are out of the range of the present invention.

TABLE 1

| alloy number examples | chemical component (wt %) | | | | | | | | | | |
|---|---|---|---|---|---|---|---|---|---|---|---|
| | Mg | Si | Cu | Fe | Ti | B | Be | Mn | Cr | Zn | V |
| 1 | 2.5 | 0.21 | 0.5 | 0.12 | 0.018 | 0.0017 | 0.0008 | <0.01 | <0.01 | <0.01 | <0.01 |
| 2 | 1.6 | 0.30 | 0.4 | 0.12 | 0.016 | 0.0016 | 0.0008 | " | " | " | " |
| 3 | 3.4 | 0.22 | 0.5 | 0.14 | 0.011 | 0.0011 | 0.0009 | " | " | " | " |
| 4 | 2.6 | 0.08 | 0.6 | 0.13 | 0.009 | 0.0008 | 0.0008 | " | " | " | " |
| 5 | 2.4 | 0.31 | 0.5 | 0.13 | 0.010 | 0.0011 | 0.0010 | " | " | " | " |
| 6 | 2.0 | 0.20 | 0.3 | 0.12 | 0.013 | 0.0012 | 0.0009 | " | " | " | " |
| 7 | 2.6 | 0.19 | 0.9 | 0.14 | 0.014 | 0.0012 | 0.0008 | " | " | " | " |
| 8 | 2.5 | 0.20 | 0.6 | 0.05 | 0.012 | 0.0011 | 0.0009 | " | " | " | " |
| 9 | 2.5 | 0.22 | 0.6 | 0.41 | 0.013 | 0.0012 | 0.0009 | " | " | " | " |
| 10 | 2.6 | 0.18 | 0.5 | 0.13 | 0.006 | 0.0004 | 0.0008 | " | " | " | " |
| 11 | 2.5 | 0.18 | 0.4 | 0.12 | 0.13 | 0.0470 | 0.0009 | " | " | " | " |
| 12 | 2.5 | 0.21 | 0.5 | 0.12 | 0.121 | 0.0011 | 0.0008 | 0.42 | 0.11 | " | " |
| 13 | 2.6 | 0.17 | 0.4 | 0.11 | 0.013 | 0.0012 | 0.0009 | <0.01 | <0.01 | 0.11 | 0.16 |

TABLE 2

| alloy number comparative examples | chemical component (wt %) | | | | | | | | | | |
|---|---|---|---|---|---|---|---|---|---|---|---|
| | Mg | Si | Cu | Fe | Ti | B | Be | Mn | Cr | Zn | V |
| 14 | 1.3 | 0.31 | 0.5 | 0.12 | 0.018 | 0.0017 | 0.0008 | <0.01 | <0.01 | <0.01 | <0.01 |
| 15 | 3.8 | 0.21 | 0.5 | 0.12 | 0.017 | 0.0017 | 0.0008 | " | " | " | " |
| 16 | 2.4 | 0.01 | 0.6 | 0.131 | 0.018 | 0.0018 | 0.0009 | " | " | " | " |
| 17 | 2.5 | 0.40 | 0.5 | 0.14 | 0.016 | 0.0015 | 0.0008 | " | " | " | " |
| 18 | 2.5 | 0.20 | 0.2 | 0.11 | 0.016 | 0.0015 | 0.0009 | " | " | " | " |
| 19 | 2.6 | 0.18 | 1.2 | 0.13 | 0.017 | 0.0017 | 0.0009 | " | " | " | " |
| 20 | 2.4 | 0.17 | 0.5 | 0.01 | 0.018 | 0.0018 | 0.0008 | " | " | " | " |
| 21 | 2.6 | 0.19 | 0.6 | 0.60 | 0.017 | 0.0017 | 0.0009 | " | " | " | " |
| 22 | 2.5 | 0.17 | 0.5 | 0.13 | 0.002 | 0.0001 | 0.0009 | " | " | " | " |
| 23 | 2.5 | 0.18 | 0.5 | 0.14 | 0.190 | 0.060 | 0.0009 | " | " | " | " |
| 24 | 2.6 | 0.20 | 0.6 | 0.12 | 0.017 | 0.0017 | 0.0008 | 0.6 | 0.20 | " | " |
| 25 | 2.5 | 0.21 | 0.5 | 0.14 | 0.016 | 0.0015 | 0.0008 | <0.01 | <0.01 | 0.15 | 0.20 |
| 26 | 3.1 | 0.22 | 0.4 | 0.12 | 0.018 | 0.0017 | 0.0009 | " | " | <0.01 | <0.01 |

The above obtained sheets of 1 mm in thickness were heated to 550° C. at a heating rate of 10° C./second, kept for 10 seconds, and cooled compulsorily to 100° C. at a cooling rate of 20° C./second.

After the heat treatment was finished, the sheets were kept at room temperature for two days. Thereafter the sheets were subject to a preliminary aging treatment at 60° C. for 24 hours, and then subjected to a restoring treatment at 260° C. for 10 seconds.

After the sheets thus obtained were kept for one week at room temperature, the sheets were cut off in the predetermined shapes to conduct a tensile test a stretched direction is a rolled direction according to methods described in the Japanese Industrial Standard (JIS) No. 5, and to conduct a conical cup test according to JIS Z2249 (using test tool 17 type), thereby evaluating mechanical properties and formability. The conical

TABLE 3

| alloy number examples | properties after heat treatment | | | | properties after baking | |
|---|---|---|---|---|---|---|
| | yield strength (kgf/mm$^2$) | tensile strength (kfg/mm$^2$) | elongation (%) | CCV (mm) | yield strength (kgf/mm$^2$) | *bake hardening (kgf/mm$^2$) |
| 1 | 8.1 | 22.3 | 33.2 | 39.9 | 13.5 | 5.4 |
| 2 | 7.0 | 21.1 | 31.8 | 40.0 | 12.1 | 5.1 |
| 3 | 9.2 | 23.2 | 33.8 | 39.8 | 14.4 | 5.2 |
| 4 | 8.0 | 22.1 | 33.0 | 39.9 | 13.0 | 5.0 |
| 5 | 7.9 | 21.9 | 31.5 | 40.1 | 13.0 | 5.1 |
| 6 | 7.6 | 21.5 | 32.8 | 39.9 | 12.6 | 5.0 |
| 7 | 9.1 | 23.0 | 33.1 | 39.9 | 14.6 | 5.5 |
| 8 | 7.8 | 22.0 | 32.5 | 40.0 | 13.1 | 5.3 |
| 9 | 8.1 | 22.3 | 31.8 | 40.0 | 13.1 | 5.0 |
| 10 | 7.7 | 22.1 | 32.6 | 40.0 | 13.0 | 5.3 |

TABLE 3-continued

| alloy number examples | properties after heat treatment: yield strength (kgf/mm²) | tensile strength (kfg/mm²) | elongation (%) | CCV (mm) | properties after baking: yield strength (kgf/mm²) | *bake hardening (kgf/mm²) |
|---|---|---|---|---|---|---|
| 11 | 8.2 | 22.4 | 31.8 | 40.0 | 13.4 | 5.2 |
| 12 | 8.4 | 22.7 | 31.4 | 40.1 | 13.6 | 5.2 |
| 13 | 8.5 | 23.0 | 31.2 | 40.1 | 13.7 | 5.2 |

*(yield strength after baking) − (yield strength after heat treatment)

TABLE 3

| alloy number comparative examples | properties after heat treatment: yield strength (kgf/mm²) | tensile strength (kfg/mm²) | elongation (%) | CCV (mm) | properties after baking: yield strength (kgf/mm²) | *bake hardening (kgf/mm²) |
|---|---|---|---|---|---|---|
| 14 | 6.6 | 20.7 | 33.1 | 39.9 | 9.1 | 2.5 |
| 15 | 9.6 | 23.7 | 33.5 | 39.9 | 12.4 | 2.8 |
| 16 | 7.8 | 22.3 | 32.9 | 39.9 | 13.2 | 2.5 |
| 17 | 8.4 | 22.4 | 32.5 | 40.0 | 11.4 | 3.0 |
| 18 | 7.2 | 21.1 | 32.2 | 40.0 | 7.2 | 0 |
| 19 | 9.7 | 23.6 | 26.7 | 40.6 | 14.9 | 5.2 |
| 20 | 7.5 | 21.8 | 22.3 | 41.1 | 12.9 | 5.4 |
| 21 | 8.2 | 22.5 | 23.6 | 40.9 | 10.5 | 2.3 |
| 22 | 7.4 | 21.9 | 24.1 | 40.9 | 12.6 | 5.2 |
| 23 | 8.5 | 22.7 | 18.9 | 41.5 | 13.6 | 5.1 |
| 24 | 9.0 | 21.8 | 17.6 | 41.6 | 14.2 | 5.2 |
| 25 | 8.8 | 22.6 | 16.7 | 41.7 | 13.8 | 5.0 |
| 26 | 8.3 | 22.8 | 33.4 | 39.9 | 10.3 | 2.0 |

*(yield strength after baking) − (yield strength after heat treatment)

As shown in Table 3, alloy sheets Nos. 1 to 13 of examples showed 10 kgf/mm² or less of yield strength and 30% or more of fracture elongation after the heat treatment, and 5.0 kgf/mm² or more of bake hardening by baking treatment. Therefore, it was confirmed that the alloy sheets had excellent balance of ductility-bake hardening. The sheets exhibited excellent CCV.

On the other hand, as shown in Table 4, alloy sheets Nos. 14 to 26 of complative examples shown in Table 2 possessed unsatisfactory values either in formability, in bake hardenability or in natural aging retardating property. More specifically, in alloy sheets Nos. 14, 16, and 18, which contained any of Mg, Si, and Cu contributing to bake hardening in a small amount, as well as in alloy sheets Nos. 15 and 17, which contained any of Mg, Si, and Cu in a large amount, the modulated structure was insufficiently formed and the values of bake hardening thereof were 2.1 to 3.0 kgf/mm². Alloy sheets Nos. 20, 21, 22, 23, 24 and 25, which contained any of Fe, Ti—B, Mn, Cr, Zr, V out of the range of the present invention, showed a lower elongation and a large CCV. It was confirmed that these alloy sheets had a lower formability. Alloy sheet No. 30, whose ratio of Mg/Cu did not satisfy the range of 2 to 7, was insufficient in formation of the modulated structure and showed the value of bake hardening of 2.0 kgf/mm².

Example 2

Alloy sheets were manufactured using an alloy having a chemical composition of No. 1 shown in Table 1 in the condition shown in Table 5. With respect to treatments, e.g., rolling condition and the like which are not described in Table 5, substantially the same conditions as in Example 1 were employed. The manufacturing conditions A to E in Table 5 are within the range of the present invention, but F to K are not. With respect to the thus manufactured alloy sheets, evaluation tests were conducted in substantially the same manner as in Example 1. The results are shown in Table 6.

TABLE 5

| manufacturing condition | homogenization condition (°C. × hr) | solution treatment conditions: heating rate (°C./sec) | keeping temp. and time (°C. × sec) | cooling rate (°C./sec) | preliminary aging treatment: heating tem. (°C.) | keeping time (hr) | restoring treatment: heating tem. (°C.) | keeping time (sec) |
|---|---|---|---|---|---|---|---|---|
| examples | | | | | | | | |
| A | 440 × 4 + 510 × 10 | 10 | 550 × 10 | 20 | 60 | 24 | 260 | 10 |
| B | " | 3 | " | " | " | " | " | " |
| C | " | 10 | 500 × 10 | " | " | " | " | " |
| D | 500 × 16 | " | 580 × 10 | " | " | " | " | " |
| E | 440 × 4 + 510 × 10 | " | 550 × 10 | 3 | " | " | " | " |
| comparative examples | | | | | | | | |
| F | 600 × 10 | 10 | 550 × 10 | 20 | " | " | " | " |
| G | 440 × 4 + 510 × 10 | 1 | " | " | " | " | " | " |
| H | " | 10 | 600 × 10 | " | " | " | " | " |
| I | " | " | 480 × 10 | " | " | " | " | " |
| J | " | " | 550 × 80 | " | " | " | " | " |
| K | " | " | 550 × 10 | 1 | " | " | " | " |

TABLE 6

| manufacture condition | properties after heat treatment: yield strength (kgf/mm²) | tensile strength (kfg/mm²) | elongation (%) | CCV (mm) | properties after baking: yield strength (kgf/mm²) | *bake hardening (kgf/mm²) |
|---|---|---|---|---|---|---|
| examples | | | | | | |
| A | 8.1 | 22.3 | 33.2 | 39.9 | 13.5 | 5.4 |
| B | 8.3 | 22.4 | 32.9 | 39.9 | 13.9 | 5.6 |
| C | 8.5 | 21.9 | 32.1 | 40.0 | 13.5 | 5.0 |
| D | 7.7 | 22.4 | 33.1 | 39.9 | 13.5 | 5.8 |
| E | 8.4 | 22.2 | 32.3 | 40.0 | 13.5 | 5.1 |
| comparative examples | | | | | | |
| F | 6.7 | 19.8 | 18.8 | 41.5 | 9.0 | 2.3 |
| G | 7.3 | 20.6 | 21.5 | 41.2 | 10.9 | 3.6 |
| H | 5.6 | 18.1 | 16.6 | 41.7 | 7.3 | 1.7 |
| I | 8.4 | 22.3 | 26.7 | 40.6 | 10.5 | 2.1 |
| J | 5.3 | 18.2 | 15.9 | 41.8 | 8.7 | 3.4 |
| K | 8.5 | 22.5 | 23.8 | 40.9 | 9.6 | 1.1 |

*(yield strength after baking) − (yield strength after heat treatment)

AS shown in Table 6, it was confirmed that the alloy sheets manufactured in the conditions of A to E whose manufacturing conditions were within the range of the present invention showed excellent formability (CCV) and bake hardenability. On the other hand, it was confirmed that the alloy sheets manufactured in the conditions of F to K whose manufacturing conditions were out of the range of the present invention showed insufficient results of elongation, formability, or baking hardenability.

When the homogenizing temperature or the heat treatment temperature was high, the keeping time of the solution treatment was long or the heating rate of the heating treatment was low as in Comparative Examples F, G, J, and H, abnormal grain growth occurred, with the result that elongation and formability or bake hardenability deteriorated. When a cooling rate at the time of a solution treatment was low, as in the case of K, precipitates of Al—Cu—Mg were ununiformly precipitated or were precipitated during cooling, thereby causing deterioration of bake hardenability. Further, when the alloy sheets were kept at low temperature in the solution treatment, as in the case of I, the formability of the alloy sheets deteriorated since elongation was low and sufficient bake hardening was not obtained.

Example 3

In the example, alloy sheets using an alloy having a chemical composition corresponding to No. 1 shown in Table 1 and being manufactured until the solution treatment under the conditions of A shown in Table 5 were used, and effect of the preliminary aging treatment and the restoring treatment on natural aging, mechanical properties and formability was examined. The conditions of the preliminary treatment and restoring treatment, and the test results are shown in Table 7. Evaluation tests were conducted in the same manner as in Example 1. The manufacturing conditions L to P are within the range of the present invention, but Q to u are not.

TABLE 7

| manufacturing condition | preliminary aging treatment (°C. × hr.) | restoring treatment (°C. × sec.) | properties after 3 months aging at room temperature: yield strength (kgf/mm²) | CCV (mm) | properties after baking: yield strength (kfg/mm²) | bake hardening* (kgf/mm²) | properties after 6 months aging at room temperature: yield strength (kgf/mm²) | CCV (mm) | properties after baking: yield strength (kgf/mm²) | bake hardening* (kgf/mm²) |
|---|---|---|---|---|---|---|---|---|---|---|
| examples | | | | | | | | | | |
| L | 60 × 24 | 260 × 10 | 8.2 | 39.9 | 13.7 | 5.5 | 8.1 | 39.9 | 13.4 | 5.3 |
| N | 110 × 3 | 280 × 15 | 8.0 | 39.9 | 13.3 | 5.3 | 8.2 | 40.0 | 13.6 | 5.4 |
| N | 100 × 8 | 260 × 50 | 8.4 | 40.0 | 13.4 | 5.0 | 8.3 | 40.0 | 13.5 | 5.2 |
| O | 90 × 12 | 270 × 5 | 7.8 | 39.9 | 13.2 | 5.4 | 8.1 | 40.0 | 13.3 | 5.2 |
| P | 45 × 47 | 200 × 20 | 8.1 | 39.9 | 13.2 | 5.1 | 8.2 | 39.9 | 13.3 | 5.1 |
| comparative examples | | | | | | | | | | |
| Q | 40 × 24 | 260 × 15 | 11.5 | 40.5 | 13.2 | 1.7 | 12.8 | 40.9 | 13.3 | 0.5 |
| R | 150 × 12 | 280 × 25 | 12.1 | 40.6 | 13.4 | 1.3 | 12.0 | 40.6 | 13.2 | 1.2 |
| S | 110 × 3 | 160 × 30 | 13.3 | 40.7 | 13.3 | 0 | 13.2 | 40.7 | 13.2 | 0 |
| T | 100 × 8 | 310 × 10 | 11.9 | 40.7 | 12.3 | 0.4 | 12.2 | 40.8 | 12.2 | 0 |
| U | 90 × 12 | 240 × 1 | 12.3 | 40.6 | 12.5 | 0.2 | 12.2 | 40.6 | 12.4 | 0.2 |

*(yield strength after baking) − (yield strength after heat treatment)

As shown in Table 7, it was confirmed that the alloy sheets manufactured in the conditions of L to P whose manufacturing conditions were within the range of the present invention showed excellent natural aging retadation property, since changes in yield strength, formability and bake hardenability with time were very small. On the other hand, the alloy sheets manufactured in the conditions of Q to U whose manufacturing conditions were out of the range of the present invention showed insufficient results of yield strength, formability, bake hardenability, or natural aging retardation property.

When the temperature of the preliminary aging treatment was low, as in the case of Comparative Example Q, concentration of vacancies was not sufficiently lowered. Therefore changes in properties with time due to natural aging were large, and formability and bake hardenability deteriorated.

R in which the temperature of the preliminary aging treatment was high, S in which the temperature of the restoring treatment was low, and U in which the keeping time of the restoring treatment was small, did not show a lowering of strength, thereby causing deterioration in formability and bake hardenability.

When the temperature of the restoring treatment was high, as in the case of T, a coarse Al—Cu—Mg compound was precipitated, thereby causing deterioration in formability and bake hardenability.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a natural aging retardated aluminum alloy sheet exhibiting excellent formability and an excellent bake hardenability, said method comprising the steps of:

(a) preparing an aluminum alloy ingot consisting essentially of 1.5 to 3.5% by weight of Mg, 0.3 to 1.0% by weight of Cu, 0.05 to 0.35 by weight of Si, 0.03 to 0.5% by weight of Fe, 0.005 to 0.15% by weight of Ti, 0.0002 to 0.05% by weight of B, and optionally containing at least one element selected from the group consisting of Mn, Cr, Zr, V, Zn and Be; and a balance of Al, in which Mg and Cu are in a weight ratio of Mg/Cu of 2 to 7;

(b) homogenizing the ingot in one step or in multiple steps, at a temperature of 400° to 580° C.;

(c) preparing an alloy sheet having a desired sheet thickness by subjecting the ingot to a hot rolling and a cold rolling;

(d) subjecting the alloy sheet to a heat treatment including heating the sheet up to 500° to 580° C. at a heating rate of 3° C./second or more, keeping the alloy sheet at the temperature reached for 0 to 60 seconds, and cooling at a cooling rate of 2° C./second or more;

(e) subjecting the alloy sheet to a preliminary aging treatment at a temperature of 45° to 100° C. for 2 to 48 hours after keeping the alloy sheet at room temperature, or immediately after said heat treatment; and (f) subjecting the alloy sheet to a restoring treatment at a temperature of 180° to 300° C. for 3 to 60 seconds.

2. The method according to claim 1, wherein said aluminum alloy ingot contains comprises at least one element selected from the group consisting of 0.01 to 0.50% by weight of Mn, 0.01 to 0.15% by weight of Cr, 0.01 to 0.12% by weight of Zr, 0.01 to 0.18% by weight of v, and 0.5% or less by weight of Zn.

3. The method according to claim 1, wherein said aluminum alloy ingot contains comprises 0.01% or less by weight of Be.

4. The method according to claim 1, wherein in said homogenizing step, the ingot is kept at the temperature of 400° to 580° C. for 1 to 72 hours.

5. The method according to claim 1, wherein the homogenizing is carried out for 1 to 72 hours.

6. The method according to claim 2, wherein said aluminum alloy ingot contains 0.01% or less by weight of Be.

7. The method according to claim 1, wherein said aluminum alloy ingot is selected from the group consisting of (a) 2.5% by weight of Mg, 0.21% by weight of Si, 0.5% by weight of Cu, 0.12% by weight of Fe, 0.018% by weight of Ti, 0.0017% by weight of B, 0.0008% by weight of Be, <0.01% by weight of Mn, <0.01% by weight of Cr, <0.01% by weight of Zn, <0.01% by weight of V and the balance Al;

(b) 1.6% by weight of Mg, 0.30% by weight of Si, 0.4% by weight of Cu, 0.12% by weight of Fe, 0.016% by weight of Ti, 0.0016% by weight of B, 0.0008% by weight of Be, <0.01% by weight of Mn, <0.01% by weight of Cr, <0.01% by weight of Zn, <0.01% by weight of V and the balance Al;

(c) 3.4% by weight of Mg, 0.22% by weight of Si, 0.5% by weight of Cu, 0.14% by weight of Fe, 0.011% by weight of Ti, 0.0011% by weight of B, 0.0009% by weight of Be, <0.01% by weight of Mn, <0.01% by weight of Cr, <0.01% by weight of Zn, <0.01% by weight of V and the balance Al;

(d) 2.6% by weight of Mg, 0.08% by weight of Si, 0.6% by weight of Cu, 0.13% by weight of Fe, 0.009% by weight of Ti, 0.0008% by weight of B, 0.0008% by weight of Be, <0.01% by weight of Mn, <0.01% by weight of Cr, <0.01% by weight of Zn, <0.01% by weight of V and the balance Al;

(e) 2.4% by weight of Mg, 0.31% by weight of Si, 0.5% by weight of Cu, 0.13% by weight of Fe, 0.010% by weight of Ti, 0.0011% by weight of B, 0.0010% by weight of Be, <0.01% by weight of Mn, <0.01% by weight of Cr, <0.01% by weight of Zn, <0.01% by weight of V and the balance Al;

(f) 2.0% by weight of Mg, 0.20% by weight of Si, 0.3% by weight of Cu, 0.12% by weight of Fe, 0.013% by weight of Ti, 0.0012% by weight of B, 0.0009% by weight of Be, <0.01% by weight of Mn, <0.01% by weight of Cr, <0.01% by weight of Zn, <0.01% by weight of V and the balance Al;

(g) 2.6% by weight of Mg, 0.19% by weight of Si, 0.9% by weight of Cu, 0.14% by weight of Fe, 0.014% by weight of Ti, 0.0012% by weight of B, 0.0008% by weight of Be, <0.01% by weight of Mn, <0.01% by weight of Cr, <0.01% by weight of Zn, <0.01% by weight of V and the balance Al;

(h) 2.5% by weight of Mg, 0.20% by weight of Si, 0.6% by weight of Cu, 0.05% by weight of Fe, 0.012% by weight of Ti, 0.0011% by weight of B, 0.0009% by weight of Be, <0.01% by weight of Mn, <0.01% by weight of Cr, <0.01% by weight of Zn, <0.01% by weight of V and the balance Al;

(i) 2.5% by weight of Mg, 0.22% by weight of Si, 0.6% by weight of Cu, 0.41% by weight of Fe, 0.013% by weight of Ti, 0.0012% by weight of B, 0.0009% by weight of Be, <0.01% by weight of Mn, <0.01% by weight of Cr, <0.01% by weight of Zn, <0.01% by weight of V and the balance Al;

(j) 2.6% by weight of Mg, 0.18% by weight of Si, 0.5% by weight of Cu, 0.13% by weight of Fe, 0.006% by weight of Ti, 0.0004% by weight of B, 0.0008% by weight of Be, <0.01% by weight of Mn, <0.01% by weight of Cr, <0.01% by weight of Zn, <0.01% by weight of V and the balance Al;

(k) 2.5% by weight of Mg, 0.18% by weight of Si, 0.4% by weight of Cu, 0.12% by weight of Fe, 0.13% by weight of Ti, 0.0470% by weight of B, 0.0009% by weight of Be, <0.01% by weight of Mn, <0.01% by weight of Cr, <0.01% by weight of Zn, <0.01% by weight of V and the balance Al;

(l) 2.5% by weight of Mg, 0.21% by weight of Si, 0.5% by weight of Cu, 0.12% by weight of Fe, 0.012% by weight of Ti, 0.0011% by weight of B, 0.0008% by weight of Be, 0.42% by weight of Mn, 0.11% by weight of Cr, <0.01% by weight of Zn, <0.01% by weight of V and the balance Al; and (m) 2.6% by weight of Mg, 0.17% by weight of Si, 0.4% by weight of Cu, 0.11% by weight of Fe, 0.013% by weight of Ti, 0.0012% by weight of B, 0.0009% by weight of Be, <0.01% by weight of Mn, <0.01% by weight of Cr, 0.11% by weight of Zn, 0.16% by weight of V and the balance Al.

8. The method according to claim 7, wherein said aluminum alloy ingot is homogenized for 4 hours at 440° C. and then for 10 hours at 510° C., then heated to 460° C. and hot-rolled to form a sheet having a thickness of 4 mm, then cooled at room temperature and cold-rolled to form a sheet having a thickness of 1 mm, then heat treated to 550° C. at a heating rate of 10° C./second for a keeping time of 10 seconds and cooled to 100° C. at a cooling rate of 20° C./second, then preliminary aged at 60° C. for 24 hours and subjected to the restoring treatment at 260° C. for 10 seconds.

9. The method according to claim 7, wherein the homogenizing is carried out for 4 hours at 440° C. and then for 10 hours at 510° C.; the heat treating is carried out by heating the sheet to 550° C. at a heating rate of 3° C./second for a keeping time of 10 seconds and cooling the sheet at a cooling rate of 20° C./second; the preliminary aging is carried out at 60° C. for 24 hours; and the restoring treatment is carried out at 260° C. for 10 seconds.

10. The method according to claim 7, wherein the homogenizing is carried out for 4 hours at 440° C. and then for 10 hours at 510° C.; the heat treating is carried out by heating the sheet to 500° C. at a heating rate of 10° C./second for a keeping time of 10 seconds and cooling the sheet at a cooling rate of 20° C./second; the preliminary aging is carried out at 60° C. for 24 hours; and the restoring treatment is carried out at 260° C. for 10 seconds.

11. The method according to claim 7, wherein the homogenizing is carried out for 16 hours at 500° C.; the heat treating is carried out by heating the sheet to 580° C. at a heating rate of 10° C./second for a keeping time of 10 seconds and cooling the sheet at a cooling rate of 20° C./second; the preliminary aging is carried out at 60° C. for 24 hours; and the restoring treatment is carried out at 260° C. for 10 seconds.

12. The method according to claim 7, wherein the homogenizing is carried out for 4 hours at 440° C. and then for 10 hours at 510° C.; the heat treating is carried out by heating the sheet to 550° C. at a heating rate of 10° C./second for a keeping time of 10 seconds and cooling the sheet at a cooling rate of 3° C./second; the preliminary aging is carried out at 60° C. for 24 hours; and the restoring treatment is carried out at 260° C. for 10 seconds.

* * * * *